US010490162B2

(12) United States Patent
Li et al.

(10) Patent No.: US 10,490,162 B2
(45) Date of Patent: Nov. 26, 2019

(54) DISPLAY CONTROL METHOD AND DEVICE, AND COMPUTER READABLE STORAGE MEDIUM

(71) Applicant: Beijing Xiaomi Mobile Software Co., Ltd., Haidian District, Beijing (CN)

(72) Inventors: Guosheng Li, Beijing (CN); Donglei Ji, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 32 days.

(21) Appl. No.: 15/795,277

(22) Filed: Oct. 27, 2017

(65) Prior Publication Data

US 2018/0308453 A1 Oct. 25, 2018

(30) Foreign Application Priority Data

Apr. 19, 2017 (CN) ..... 2017 1 0258259

(51) Int. Cl.

| | |
|---|---|
| ***G09G 5/10*** | (2006.01) |
| *G09G 3/3208* | (2016.01) |
| *G09G 3/36* | (2006.01) |

(52) U.S. Cl.

CPC ..... *G09G 5/10* (2013.01); *G09G 3/3208* (2013.01); *G09G 3/36* (2013.01); *G09G 2320/0626* (2013.01); *G09G 2320/0666* (2013.01); *G09G 2360/145* (2013.01)

(58) Field of Classification Search

CPC .. G09G 5/10; G09G 5/02; G09G 3/20; G09G 3/013; G09G 3/001; G09G 3/2003; G09G 3/3406

USPC ..... 345/694

See application file for complete search history.

(56) References Cited

U.S. PATENT DOCUMENTS

| | | | | |
|---|---|---|---|---|
| 9,858,895 | B2 * | 1/2018 | Li | G09G 5/10 |
| 10,049,643 | B1 * | 8/2018 | Wu | G09G 5/02 |
| 10,192,519 | B2 * | 1/2019 | Chen | G09G 3/2003 |
| 2002/0047590 | A1 * | 4/2002 | Kawano | G09G 5/14 315/169.4 |

(Continued)

FOREIGN PATENT DOCUMENTS

| | | |
|---|---|---|
| CN | 104052878 A | 9/2014 |
| CN | 104934014 A | 9/2015 |

(Continued)

OTHER PUBLICATIONS

Extended European Search Report for EP application 17200424, dated Mar. 12, 2018.

(Continued)

*Primary Examiner* — Fred Tzeng

(74) *Attorney, Agent, or Firm* — Jun He Law Offices P.C.; James J. Zhu

(57) ABSTRACT

The present disclosure relates to a display control method, a display control device and a computer readable storage medium. The display control method includes: detecting whether a display panel is in a low brightness mode and/or a low ambient light mode; enabling an eye protection mode when it is determined that the display panel is in the low brightness mode and/or the low ambient light mode, in which, in the eye protection mode, brightness of a color component of the display panel is further reduced with respect to the low brightness mode to reduce damage to human eyes.

17 Claims, 8 Drawing Sheets

(56) References Cited

U.S. PATENT DOCUMENTS

2004/0130555 A1* 7/2004 Ko ..... G09G 5/02 345/589
2005/0200868 A1* 9/2005 Yoshida ..... H04N 1/6027 358/1.9
2007/0279373 A1* 12/2007 Tseng ..... G09G 3/3406 345/102
2008/0055228 A1* 3/2008 Glen ..... G09G 3/3406 345/102
2008/0316349 A1* 12/2008 Toyoda ..... H04N 5/2351 348/333.01
2009/0278828 A1* 11/2009 Fletcher ..... G06F 1/3203 345/207
2010/0094501 A1* 4/2010 Kwok ..... G02B 27/01 701/36
2012/0162110 A1* 6/2012 Kobayashi ..... G06F 1/1643 345/173
2012/0182275 A1* 7/2012 Chen ..... G09G 5/10 345/207
2012/0299983 A1* 11/2012 Chang ..... G09G 3/3614 345/691
2014/0176518 A1* 6/2014 Min ..... G09G 3/20 345/207
2014/0320552 A1* 10/2014 Seo ..... G09G 3/3648 345/690
2014/0333450 A1* 11/2014 Savage, Jr. ..... G08B 5/38 340/815.45
2015/0042696 A1* 2/2015 Ooga ..... G09G 3/3406 345/690
2015/0077569 A1* 3/2015 Ho ..... H04N 5/23219 348/170
2015/0269709 A1* 9/2015 Zhao ..... G06T 3/4092 345/589
2016/0028965 A1* 1/2016 Horii ..... H04N 5/225 348/333.01
2016/0034737 A1* 2/2016 Goren ..... G06K 7/146 235/455
2016/0076728 A1* 3/2016 Feng ..... B08B 7/0057 362/20
2016/0142603 A1* 5/2016 Chen ..... H04N 5/2256 348/371
2016/0175964 A1* 6/2016 Penoyer ..... B23K 9/0956 219/124.34
2016/0180801 A1* 6/2016 Lee ..... H04M 1/72569 345/156
2016/0284279 A1* 9/2016 Li ..... G09G 3/3406
2016/0314762 A1* 10/2016 Lee ..... G09G 3/001
2017/0011678 A1* 1/2017 Cao ..... G09G 3/2003
2017/0039919 A1 2/2017 Wu
2017/0047019 A1* 2/2017 Li ..... G09G 3/36
2017/0079118 A1* 3/2017 Chen ..... G06F 3/013
2017/0323591 A1* 11/2017 Siminoff ..... G09F 27/004
2018/0204524 A1* 7/2018 Kucera ..... G09G 3/3406

FOREIGN PATENT DOCUMENTS

CN 105825837 A 8/2016
CN 106155619 A 11/2016
CN 106155620 A 11/2016
JP 2006030826 A 2/2006
JP 2007236810 A 9/2007
JP 2008164766 A 7/2008
JP 2016021059 A 2/2016
WO 2013125318 A1 8/2013

OTHER PUBLICATIONS

International Search Report for International application PCT/CN2017/095897, dated Jan. 22, 2018.
The First Office Action in Chinese Patent Application No. 201710258259.X, dated Mar. 29, 2019.
The Notice of Reasons for Refusal in Japanese Patent Application No. 2017-553381, dated Jul. 22, 2019.

* cited by examiner

DISPLAY CONTROL METHOD AND DEVICE, AND COMPUTER READABLE STORAGE MEDIUM

CROSS-REFERENCE TO RELATED APPLICATIONS

This application is based on and claims priority to Chinese Patent Application No. 201710258259.X, filed on Apr. 19, 2017, the entire contents of which are incorporated herein by reference.

TECHNICAL FIELD

The present disclosure generally relates to a terminal technology field, and more particularly, to a display control method, a display control device, and a computer readable storage medium.

BACKGROUND

In order to reduce damage of a screen to a user, a screen of an existing display device has an eye protection mode, and after the user enables the eye protection mode manually, brightness of the screen can be reduced, thus avoiding damage to eyes of the user.

However, currently in the related art, on one hand, the user needs to manually enable the eye protection mode, which is difficult for the user to perform when the existing display device has too many functions; on the other hand, only brightness of blue light is reduced, such that the displayed picture appears to be yellowish, thus resulting in worse viewing experience of the user.

SUMMARY

Embodiments of the present disclosure provide a display control method, a display control device, an electronic device and a computer readable storage medium to solve the problems in the related art.

According to a first aspect of the embodiments of the present disclosure, there is provided a display control method, including: detecting whether a display panel is in a low brightness mode and/or a low ambient light mode, in which, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and enabling an eye protection mode when it is determined that the display panel is in the low brightness mode and/or the low ambient light mode, in which, in the eye protection mode, brightness of a color component of a user in the display panel is reduced with respect to in the low brightness mode to reduce damage to human eyes.

According to a second aspect of the embodiments of the present disclosure, there is provided a display control device, including: a processor and a memory configured to store instructions executable by the processor; in which, the processor is configured to: detect whether a display panel is in a low brightness mode and/or a low ambient light mode, in which, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and enable an eye protection mode when it is determined that the display panel is in the low brightness mode and/or the low ambient light mode, in which, in the eye protection mode, brightness of a color component of the display panel is reduced with respect to in the low brightness mode to reduce damage to human eyes.

According to a third aspect of embodiments of the present disclosure, there is provided a computer readable storage medium, configured to store a computer program. When executed by processor, the computer program executes the following acts: detecting whether a display panel is in a low brightness mode and/or a low ambient light mode, in which, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and enabling an eye protection mode when it is determined that the display panel is in the low brightness mode and/or the low ambient light mode, in which, in the eye protection mode, brightness of a color component of the display panel is reduced with respect to in the low brightness mode to reduce damage to human eyes.

It is to be understood that both the foregoing general description and the following detailed description are exemplary and explanatory only and are not restrictive of the present disclosure, as claimed.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Figure 1:
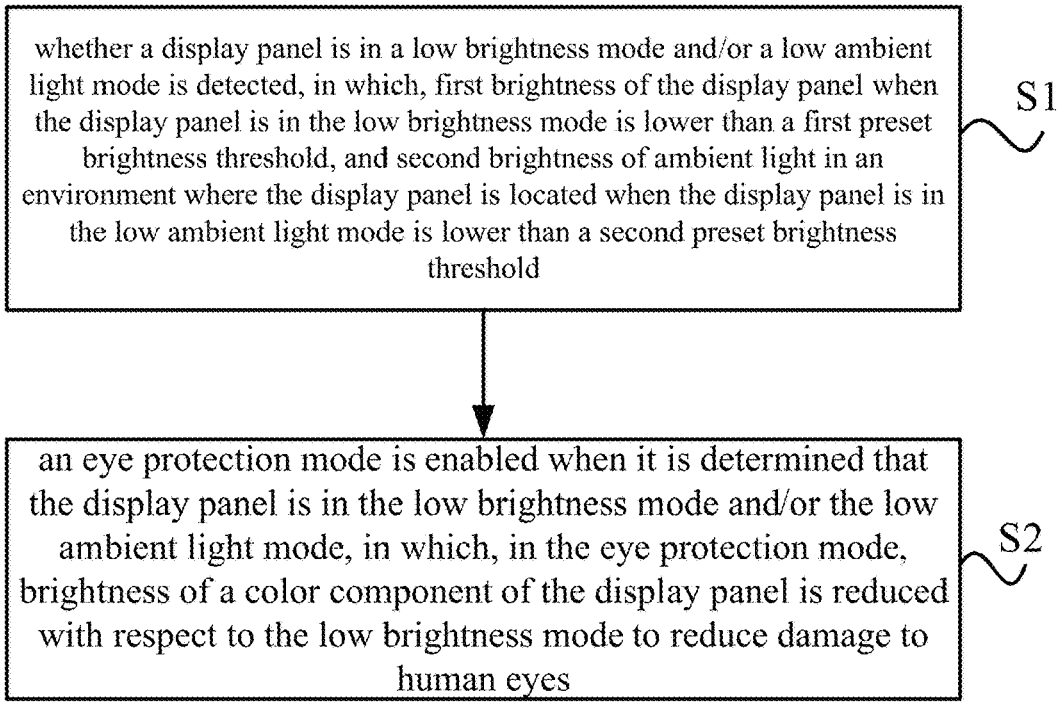
FIG. 1 is a flow chart illustrating a display control method according to an exemplary embodiment.

FIG. 1 is a flow chart illustrating a display control method according to an exemplary embodiment. The method can be used to control a display panel, in which, the display panel is applicable to a mobile phone, a tablet computer, a television and other devices. As illustrated in FIG. 1, the method includes block S1 and block S2.

In block S1, whether a display panel is in a low brightness mode and/or a low ambient light mode is detected, in which, first brightness of the display panel in the low brightness mode when the display panel is lower than a first preset brightness threshold, and second brightness of ambient light in an environment where the display panel is located when the display panel in the low ambient light mode is lower than a second preset brightness threshold.

In an embodiment, the ambient light can be received through a photoelectric sensor to generate an induced current, and the second brightness of ambient light can be determined according to a magnitude of the induced current.

In an embodiment, the display panel may be a liquid crystal display panel. In this case, the first brightness of the display panel can be determined by detecting brightness of a backlight module.

In an embodiment, the display panel may be an organic light emitting diode display panel (also, "OLED"). In this case, the first brightness of the display panel can be determined by detecting a drive current of sub-pixels in a pixel unit.

It should be noted that, the methods to detect the first brightness and the second brightness are not limited to the above-described methods, and detection methods can be selected as needed and according to the device on which the display panel is located.

In an embodiment, the display panel can adjust its brightness according to brightness of ambient light. For example, when the second brightness of the ambient light is lower than the second preset brightness threshold, brightness of the display panel may be adjusted to be lower than the first preset brightness threshold, that is, adjusted to the low brightness mode, however, this adjustment process may take some time to complete. Therefore, in addition to when the brightness of the display panel is lower than the first preset brightness threshold, when the brightness of the ambient light is lower than the second preset brightness threshold, or when the brightness of the display panel is lower than the first preset brightness threshold and the brightness of the ambient light is lower than the second preset brightness threshold, the display panel may be determined to be in the low brightness mode, such that an eye protection mode can be enabled in time.

In an embodiment, the first preset brightness threshold and the second brightness threshold may be set as desired.

For example, the first preset brightness threshold may be greater than or equal to 1 nit, less than or equal to 1.8 nit, and preferably, may be set to be 1.5 nit. For example, the second preset brightness threshold may be greater than or equal to 0.08 lux, less than or equal to 0.12 lux, and preferably, may be set to be 0.1 lux.

In block S2, an eye protection mode is enabled when it is determined that the display panel is in the low brightness mode and/or the low ambient light mode, in which, in the eye protection mode, brightness of a color component of the display panel is further reduced with respect to in the low brightness mode to reduce damage to human eyes.

In an embodiment, when a pixel units of the display panel include red sub-pixels, green sub-pixels and blue sub-pixels, the color component can be reduced by reducing brightness of the blue sub-pixels. However, when the pixel unit of the display panel includes sub-pixels of other colors, the way to reduce the color component can be adjusted accordingly. For example, when the pixel units of the display panel include cyan sub-pixels, magenta sub-pixels and yellow sub-pixels, the color component can be reduced by reducing brightness of the cyan sub-pixels and brightness of the magenta sub-pixels. Hereinafter, embodiments of the present disclosure will be described by assuming that the pixel units include the red sub-pixels, the green sub-pixels and the blue sub-pixels.

In an embodiment, when the display panel is in the low brightness mode and/or the low ambient light mode, that is, when the brightness of the display panel is low and/or the brightness of the ambient light is low, the eye protection mode is enabled automatically, so as to further reduce the color component damaging eyes of the user in the display panel, such that the user does not need to operate manually, thereby avoiding a situation that most users are unfamiliar with functions of the display panel and cannot protect their eyes effectively because the above adjustment function is not found or cannot be found. Therefore, a scope of users that are protected is greatly improved.

Figure 2:
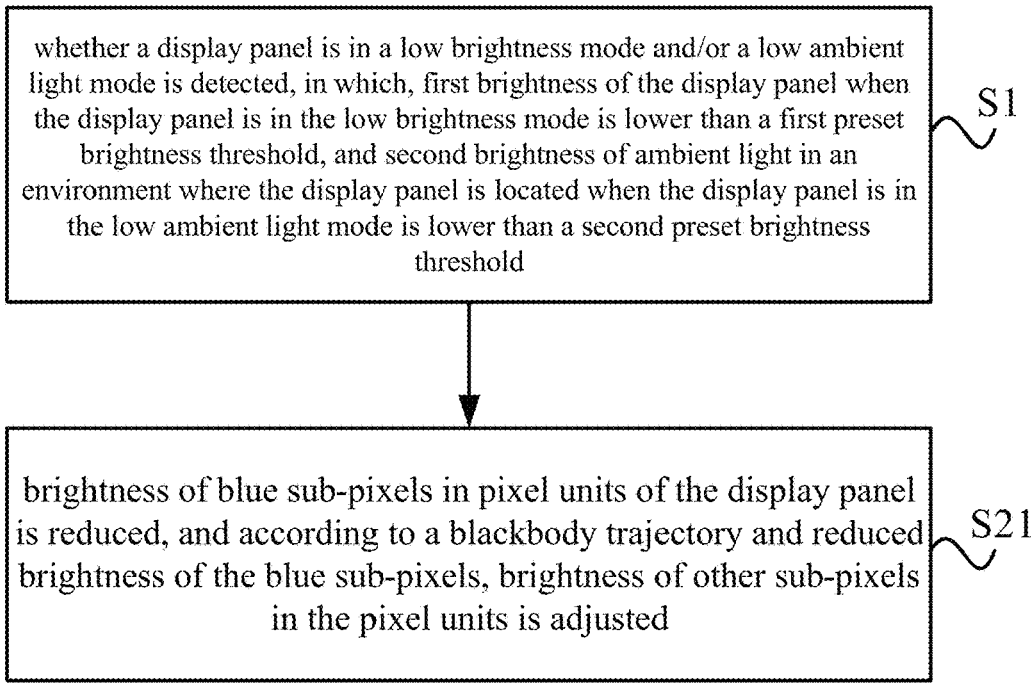
FIG. 2 is a flow chart illustrating a display control method according to another exemplary embodiment.

FIG. 2 is a flow chart illustrating a display control method according to another exemplary embodiment. As illustrated in FIG. 2, based on the embodiments illustrated in FIG. 1, enabling an eye protection mode includes block S21.

In block S21, brightness of blue sub-pixels in pixel units of the display panel is reduced, and according to a blackbody trajectory and the reduced brightness of the blue sub-pixels, brightness of other sub-pixels in the pixel units is adjusted.

In an embodiment, the pixel units may include the red sub-pixels, the green sub-pixels and the blue sub-pixels, and can further include white sub-pixels, and the number of sub-pixels of each color may be set as desired, which is not limited in the present disclosure.

In an embodiment, the first brightness can be reduced by the user from adjusting brightness of the display panel manually, or can be reduced automatically when the display panel senses that the brightness of ambient light is reduced.

In an embodiment, the first brightness is lower than a first preset brightness threshold, that is, the brightness of the display panel is low, and the second brightness is lower than a second preset brightness threshold, that is, the brightness of the ambient light is low. In one of the above cases or when both cases coexist, a sensitivity of human eyes to colors may be reduced, and too bright light will cause great damage to the human eyes. And, strong blue light can greatly damage a retina, which may cause dry eye, eye strain or internal clock disorder, and even cause eye macular degeneration and visual impairment, and the blue light may also interfere with secretion of melatonin of a human body, thereby causing sleep disorder.

Therefore, in the above two cases or when both cases coexist, the brightness of blue sub-pixels in pixel units of the display panel can be reduced. However, when only the brightness of the blue sub-pixels is reduced, a yellow (i.e., the complementary color of blue) color cast occurs in the color of a displayed picture, thus causing the picture to turn yellow. Therefore, brightness of other sub-pixels in the pixel units can be further adjusted according to a blackbody trajectory and reduced brightness of the blue sub-pixel.

Figure 3:
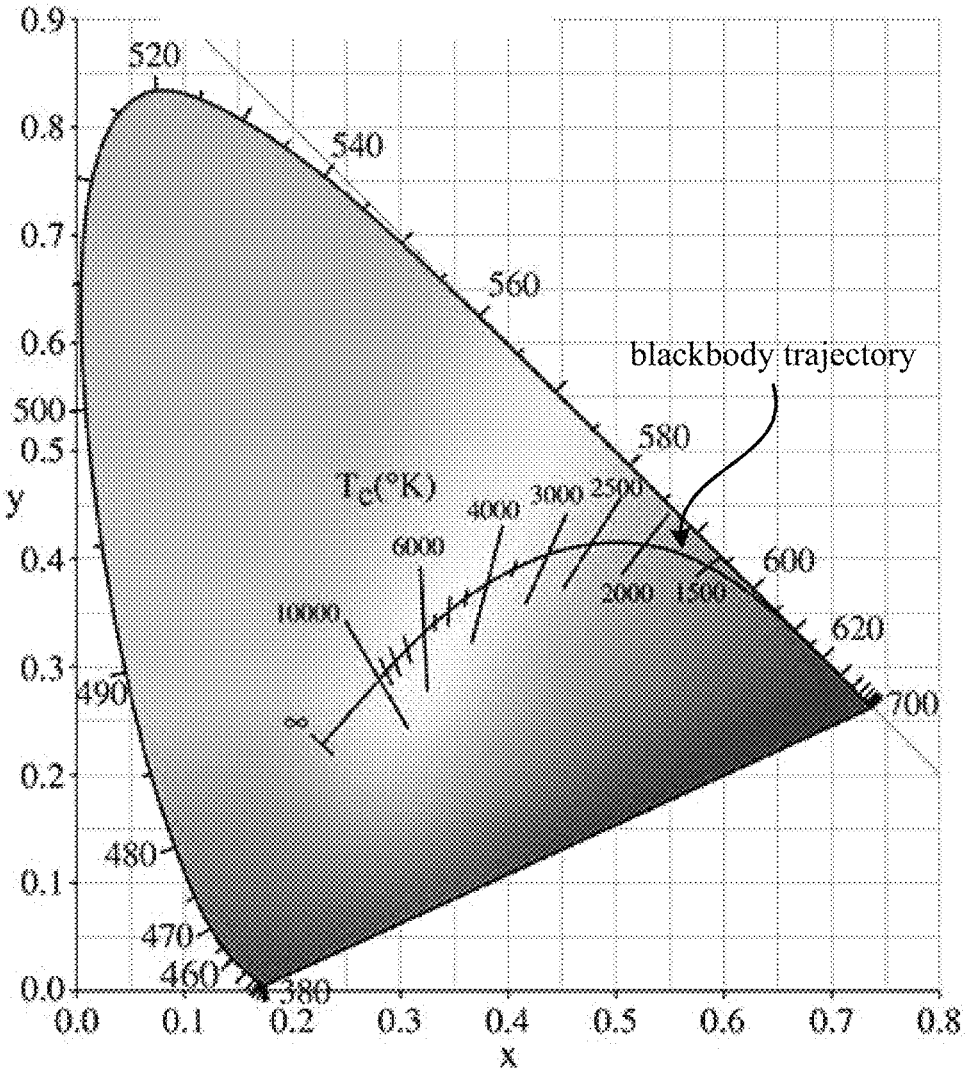
FIG. 3 is a schematic diagram illustrating a blackbody trajectory according to an exemplary embodiment.

FIG. 3 is a schematic diagram illustrating a blackbody trajectory according to an exemplary embodiment.

As illustrated in FIG. 3, in a CIE chromaticity diagram, the lower left has a color of blue, the lower right has a color of red, and the upper has a color of green, the blackbody trajectory represents a chromaticity curve of the blackbody (planckian radiator) at different temperatures in the CIE chromaticity diagram. When the displayed color is adjusted to be a point on the blackbody trajectory, human eyes can see the white color.

In an embodiment, when the brightness of the blue sub-pixels in the pixel units is reduced, the brightness of other sub-pixels in the pixel units can be adjusted (for example, increasing brightness of some sub-pixels, or reducing brightness of some sub-pixels) according to the blackbody trajectory, so that the chromaticity of light emitted by the adjusted pixel unit still changes along the blackbody trajectory. For example, for the pixel units that emit white light, a chromaticity of white light emitted by the adjusted pixel units is still on the blackbody trajectory, such that the displayed color of the pixel units will not show an obvious color cast, and viewing effect of the user will not be affected while the blue light is reduced to protect the eyes of the user.

It should be noted that, the display panel may have a switch allowing the user to enable and disable the above-described adjustment function manually. Based on this, it can be set by the user to perform the above automatic adjustment, or not to perform the above automatic adjustment.

In at least one embodiment, a time factor can be further considered, that is, when the first brightness is lower than the first preset brightness threshold, and/or the second brightness is lower than the second preset brightness threshold, and/or in a preset time period, the brightness of blue sub-pixels in the pixel units of the display panel is reduced, and according to the blackbody trajectory and the reduced brightness of the blue sub-pixel, the brightness of other sub-pixels in the pixel unit is adjusted.

In an embodiment, the preset time period may be set by the user in advance, in which, the preset time period may be a night time period, such as 22:00 to 24:00. During the preset time period, it may be determined that the user is about to turn off a light and go to sleep, that is, the user may use the mobile phone in bed. Therefore, the above adjustment can be performed during this time period, so as to ensure that the eyes can be protected and that the viewing effect of the user is barely affected when the user uses the mobile phone in bed with the light off.

Figure 4:
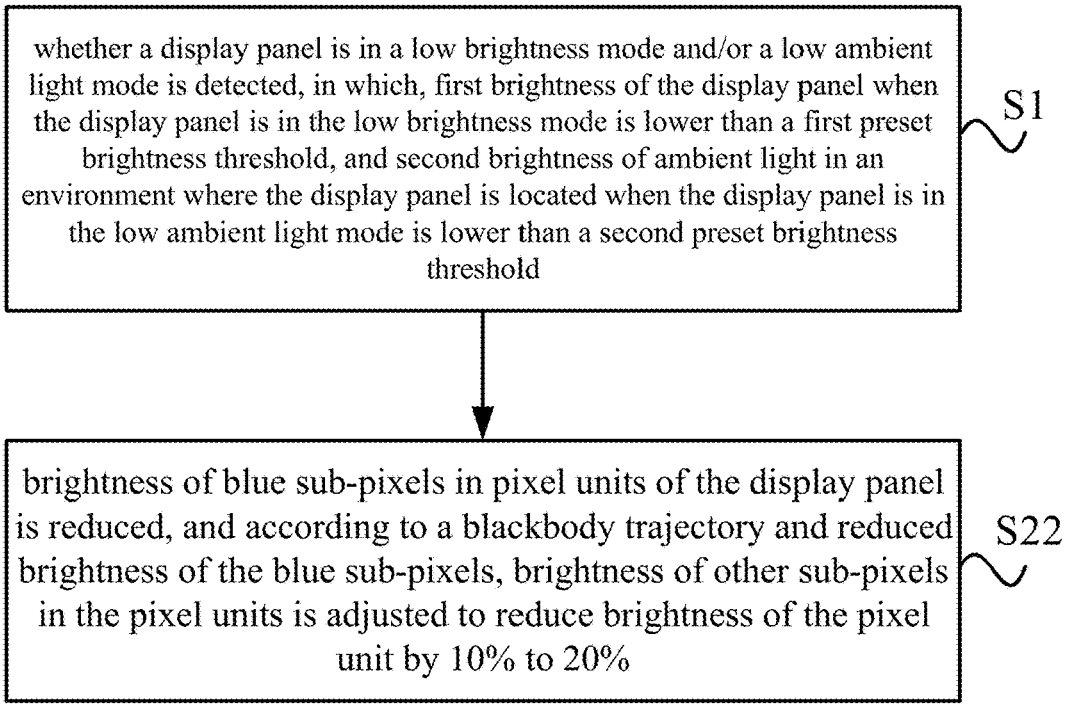
FIG. 4 is a flow chart illustrating a display control method according to another exemplary embodiment.

FIG. 4 is a flow chart illustrating a display control method according to another exemplary embodiment. As illustrated in FIG. 4, based on the embodiments illustrated in FIG. 1, enabling the eye protection mode includes block S22.

In block S22, brightness of blue sub-pixels in pixel units of the display panel is reduced, and according to a blackbody trajectory and the reduced brightness of the blue sub-pixels, brightness of other sub-pixels in the pixel units is adjusted to reduce brightness of the pixel units by 10% to 20%.

In an embodiment, although an influence to the viewing effect of the user is reduced while the eyes of the user can be protected effectively by reducing the brightness of the blue sub-pixels in the pixel units and adjusting the brightness of other sub-pixels according to the embodiments illustrated in FIG. 1, if the adjustment reduces the brightness of the pixel units too much, the user may be aware that the picture displayed in the display panel is dimmed obviously.

Therefore, the brightness of the blue sub-pixels can be reduced by reducing brightness of the pixel units by 10% to 20%, and the brightness of other sub-pixels is adjusted, so that the brightness of the pixel units will be reduced to a smaller extent, thereby further reducing the influence to the viewing effect of the user after the brightness of the sub-pixels in the pixel units is adjusted, and even ensuring that the user is not aware of a change of the brightness of the pixel units in some environments.

When the display panel is a liquid crystal display panel, by adjusting voltage of a common electrode of the blue sub-pixels and other sub-pixels in the pixel units, deflection of the corresponding liquid crystal can be changed, and then a change degree of the brightness of the blue sub-pixels and other sub-pixels can be controlled.

When the display panel is an organic light emitting diode display panel, the change degree of the brightness of the blue sub-pixels and other sub-pixels can be controlled by adjusting the drive current of the blue sub-pixel and other sub-pixels in the pixel units.

Figure 5:
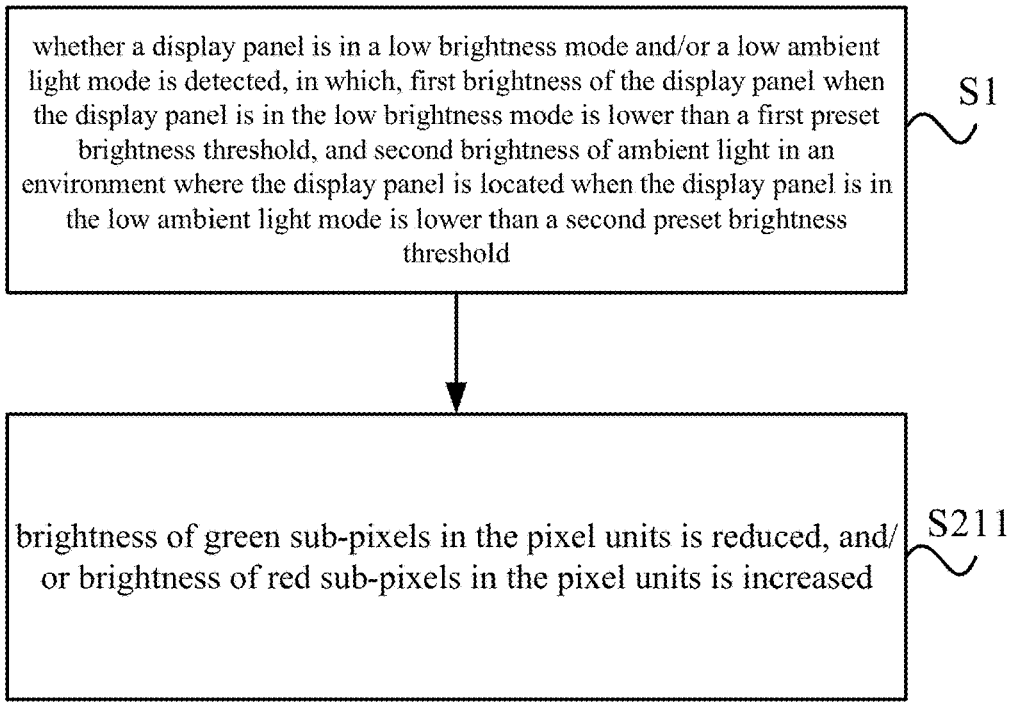
FIG. 5 is a flow chart illustrating a display control method according to another exemplary embodiment.

FIG. 5 is a flow chart illustrating a display control method according to another exemplary embodiment. As illustrated in FIG. 5, based on the embodiments illustrated in FIG. 2, adjusting brightness of other sub-pixels in the pixel units includes block S211.

In block S211, brightness of a green sub-pixel in the pixel unit is reduced, and/or brightness of a red sub-pixel in the pixel unit is increased.

In an embodiment, taking the pixel units that emit white light as an example, the chromaticity of the white light emitted by the pixel units before the adjustment is on the blackbody trajectory illustrated in FIG. 3. However, when the brightness of the blue sub-pixels is reduced, in order to keep the chromaticity of light emitted by the adjusted pixel unit still on the blackbody trajectory, brightness of the green sub-pixels can be reduced, and/or brightness of the red sub-pixels can be increased, so that the chromaticity of the light emitted by the adjusted pixel units is still on the blackbody trajectory, but just moved to right, thereby ensuring that the chromaticity of the light emitted by the pixel unit that is viewed by the user barely changes, thus reducing the influence to the viewing effect of the user.

Taking the liquid crystal display panel as an example, transmittance of the blue sub-pixels and the green sub-pixels can be reduced by reducing voltages of pixel electrodes in the blue sub-pixels and the green sub-pixels, so as to reduce brightness of both. For example, the voltage of the pixel electrodes in the blue sub-pixels can be reduced by 20%, the voltage of the pixel electrodes in the green sub-pixels can be reduced by 10%, and/or the brightness of the red sub-pixel can be increased by 5%.

In an embodiment, for pixel units that emit colored light (such as yellow light, green light, etc.), similar to the pixel units that emit white light, the brightness of the blue sub-pixels, the green sub-pixels, and/or the red sub-pixels may be adjusted in the same way and range.

Taking pixel units that emit green light as an example, the chromaticity of green light is not located on the blackbody trajectory illustrated in FIG. 3 before the adjustment, but is located on an upper area of the blackbody trajectory. When the brightness of the blue sub-pixels is reduced, in order to make the chromaticity of the light emitted by the adjusted pixel units still change along the blackbody trajectory, i.e., move right in the CIE chromaticity diagram, the brightness of the green sub-pixels can be reduced, or the brightness of the red sub-pixels can be increased, or the brightness of the green sub-pixels can be reduced while brightness of the red sub-pixels is increased, so that the chromaticity of light emitted by the adjusted pixel units is similar to that before the adjustment, thereby ensuring that the chromaticity of the light emitted by the pixel units that is viewed by the user barely changes, and reducing the influence to the viewing effect of the user.

Figure 6:
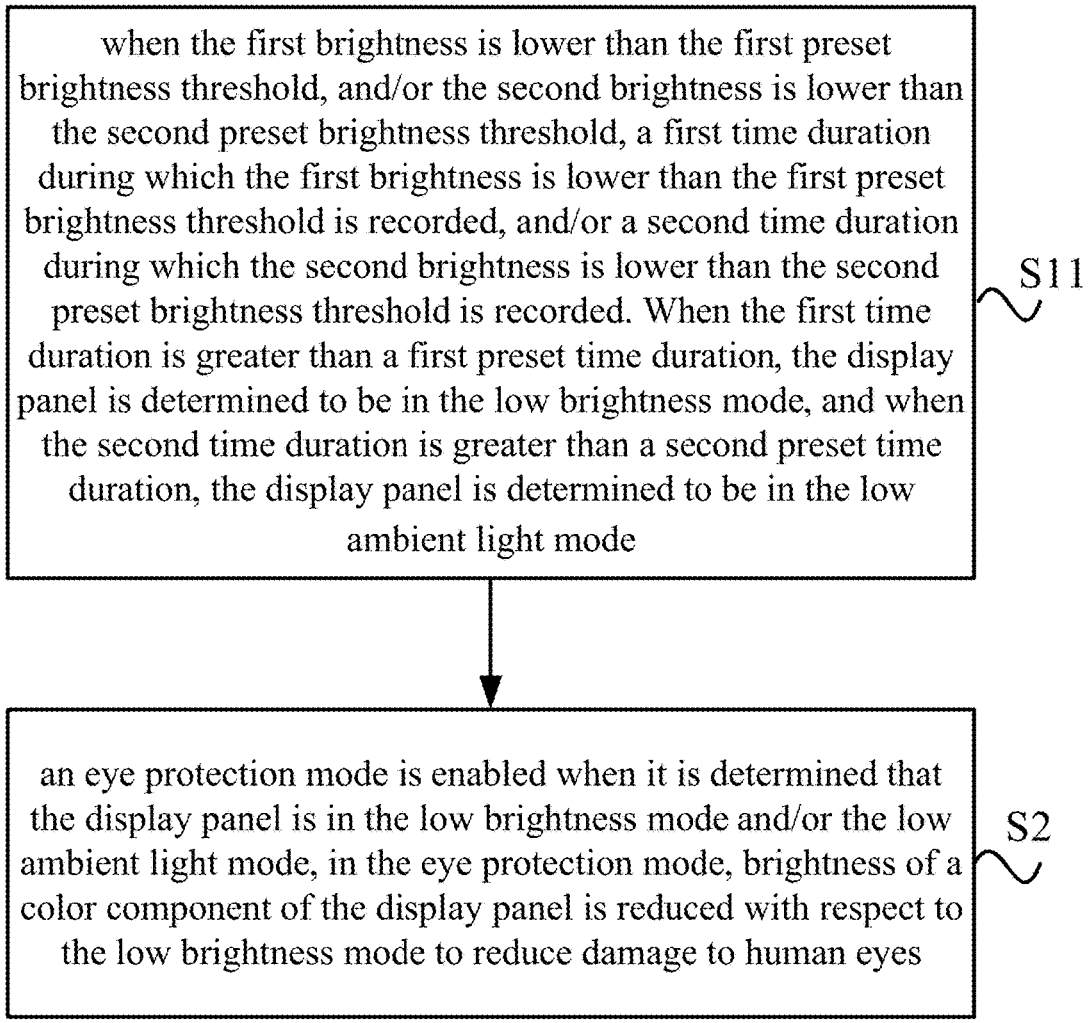
FIG. 6 is a flow chart illustrating a display control method according to another exemplary embodiment.

FIG. 6 is a flow chart illustrating a display control method according to another exemplary embodiment. As illustrated in FIG. 6, based on the embodiments illustrated in FIG. 1, detecting whether the display panel is in the low brightness mode and/or the low ambient light mode includes block S11.

In block S11, when the first brightness is lower than the first preset brightness threshold, and/or the second brightness is lower than the second preset brightness threshold, a first time duration during which the first brightness is lower than the first preset brightness threshold is recorded, and/or a second time duration during which the second brightness is lower than the second preset brightness threshold is recorded. When the first time duration is greater than a first preset time duration, the display panel is determined to be in the low brightness mode, and when the second time duration is greater than a second preset time duration, the display panel is determined to be in the low ambient light mode.

According to the embodiments of the present disclosure, the above-described process of adjusting the brightness of the pixel units can be performed automatically when the first brightness is lower than the first preset brightness threshold and/or the second brightness is lower than the second preset brightness threshold. However, in some cases, although the first brightness is lower than the first preset brightness threshold and/or the second brightness is lower than the second preset brightness threshold, the user does not need to adjust brightness of the pixel units. For example, assuming that the user carrying the terminal configured with the display panel described above, turns off the light and prepares to go out from a bedroom, there may be case that the second brightness is lower than the second preset brightness threshold when the user turns off the light. However, the user is about to enter a bright environment, thus there is no need to adjust brightness of the display panel.

Based on this, it is possible to determine, by determining whether the first time duration during which the first brightness is lower than the first preset brightness threshold is long enough (greater than a first preset time duration), and/or whether the second time duration during which the second brightness is lower than the second preset brightness threshold is long enough (greater than a second preset time duration), whether the user is steadily in the situation where brightness of ambient light is low or brightness of the mobile phone is low. Only when the user is steadily in the situation where brightness of ambient light is low or brightness of the mobile phone is low, an operation of enabling the eye protection mode is performed, and brightness of the blue sub-pixels in the pixel units of the display panel is reduced. However, when the user is not steadily in the situation where brightness of ambient light is low or brightness of the mobile phone is low, original brightness of the display panel is maintained, thereby avoiding misjudging the situation where the user is in to adjust brightness of a display screen to enable the eye protection mode.

Figure 7:
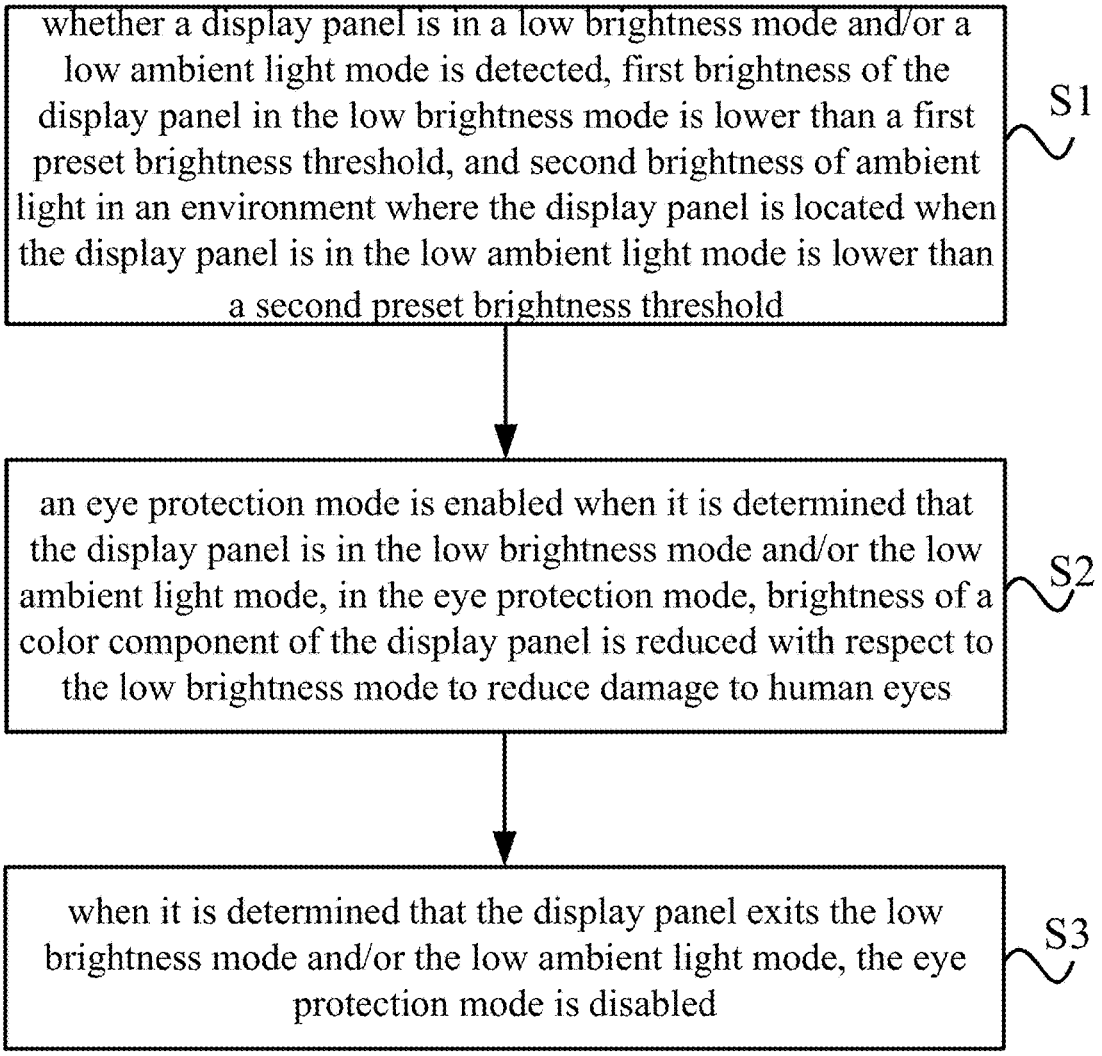
FIG. 7 is a flow chart illustrating a display control method according to another exemplary embodiment.

FIG. 7 is a flow chart illustrating a display control method according to another exemplary embodiment. As illustrated in FIG. 7, based on the embodiments illustrated in FIG. 1, the method further includes block S3.

In block S3, when it is determined that the display panel exits the low brightness mode and/or the low ambient light mode, the eye protection mode is disabled.

In an embodiment, when the display panel exits the low brightness mode, the brightness of the display panel can be reset to nearly a normal level. In this case, the user generally needs to watch a picture with a higher brightness, thus the eye protection mode can be further disabled to ensure the viewing effect of the user.

Figure 8:
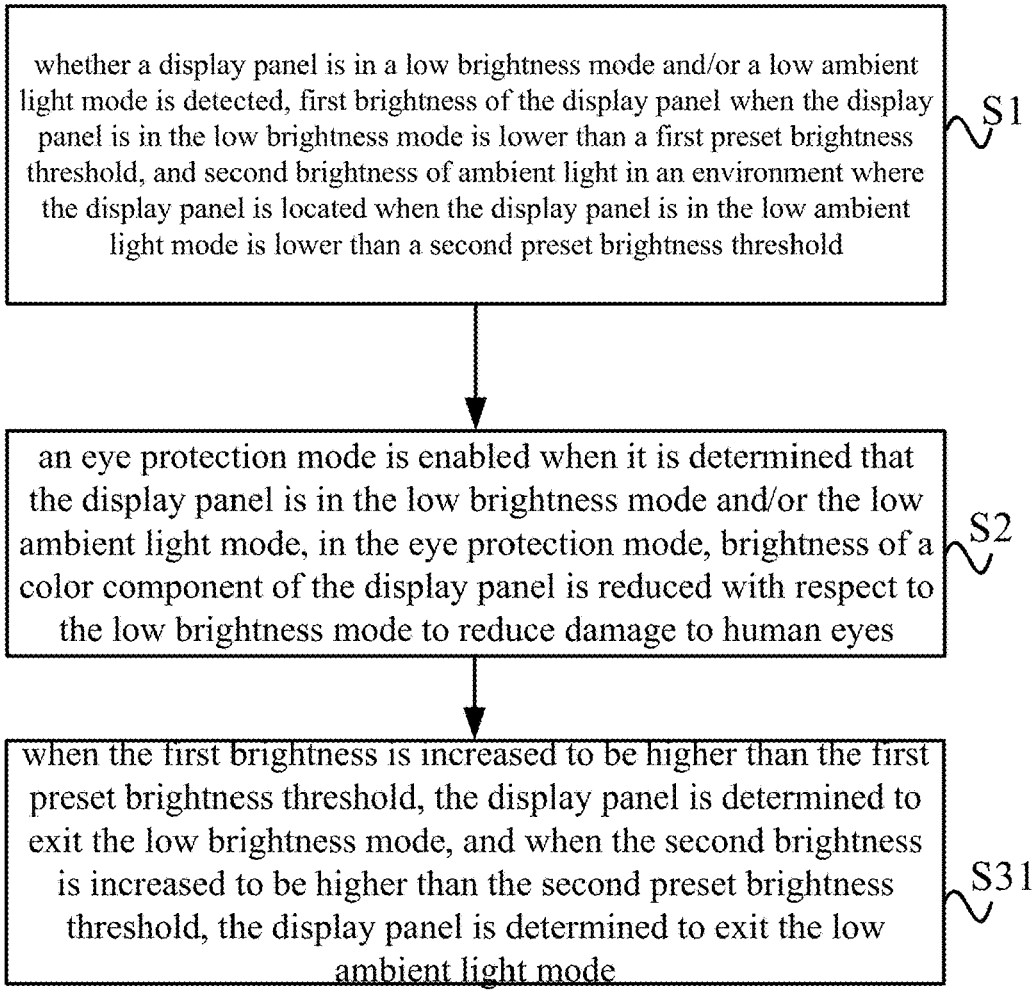
FIG. 8 is a flow chart illustrating a display control method according to another exemplary embodiment.

FIG. 8 is a flow chart illustrating a display control method according to another exemplary embodiment. As illustrated in FIG. 8, based on the embodiments illustrated in FIG. 7, determining that the display panel exits the low brightness mode includes block S31.

In block S31, when the first brightness is increased to be higher than the first preset brightness threshold, the display panel is determined to exit the low brightness mode, and when the second brightness is increased to be higher than the second preset brightness threshold, the display panel is determined to exit the low ambient light mode.

Corresponding to the embodiments of the display control method, the present disclosure further provides embodiments of a display control device.

Figure 9:
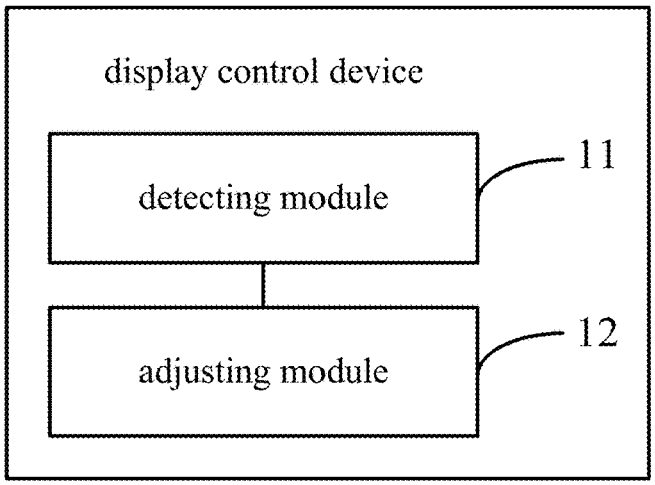
FIG. 9 is a block diagram illustrating a display control device according to an exemplary embodiment.

FIG. 9 is a block diagram illustrating a display control device according to an exemplary embodiment. As illustrated in FIG. 9, the device includes a detecting module 91 and an adjusting module 92.

The detecting module 91 is configured to detect whether a display panel is in a low brightness mode and/or a low ambient light mode, in which, first brightness of the display panel when the display panel is in the low brightness mode is lower than a first preset brightness threshold, and second brightness of ambient light in an environment where the display panel is located when the display panel is in the low ambient light mode is lower than a second preset brightness threshold.

The adjusting module 92 is configured to enable an eye protection mode when it is determined that the display panel is in the low brightness mode and/or the low ambient light mode, in which, in the eye protection mode, brightness of a color component of the display panel is further reduced with respect to the low brightness mode to reduce damage to human eyes.

In at least one embodiment, the adjusting module 92 is configured to, when it is determined that the display panel is in the low brightness mode, reduce brightness of blue sub-pixels in pixel units of the display panel, and adjust brightness of other sub-pixels in the pixel units according to a blackbody trajectory and the reduced brightness of the blue sub-pixels.

In at least one embodiment, the adjusting module 92 is configured to reduce the brightness of blue sub-pixels in the pixel units of the display panel, and adjust the brightness of other sub-pixels in the pixel units according to a blackbody trajectory and reduced the brightness of the blue sub-pixels to reduce the brightness of the pixel units by 10% to 20%.

Figure 10:
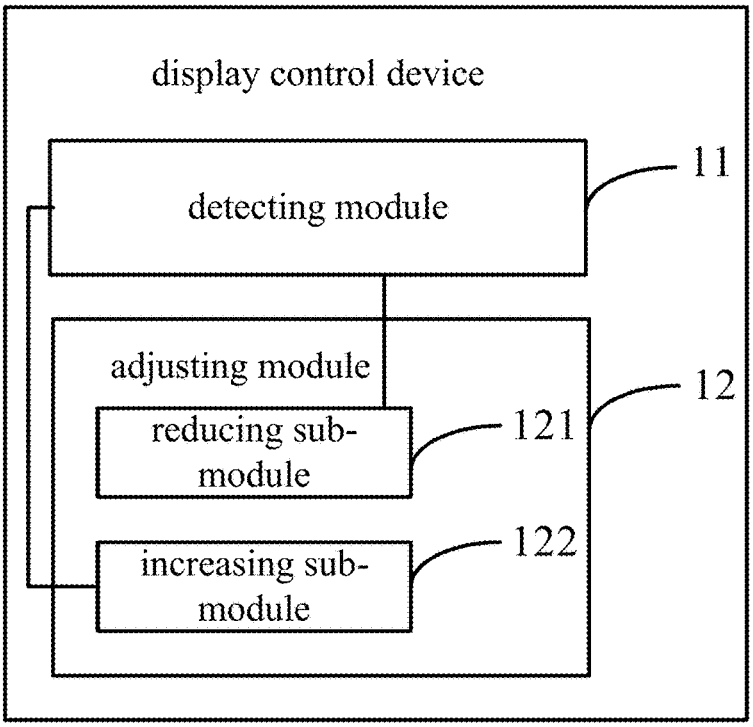
FIG. 10 is a block diagram illustrating a display control device according to another exemplary embodiment.

FIG. 10 is a block diagram illustrating a display control device according to another exemplary embodiment. As illustrated in FIG. 10, the adjusting module 92 includes a reducing sub-module 921 and an increasing sub-module 922.

The reducing sub-module 921 is configured to reduce brightness of green sub-pixels in the pixel units when the pixel units emit non-white light.

The increasing sub-module 922 is configured to increase brightness of red sub-pixels in the pixel units when the pixel units emit non-white light.

Figure 11:
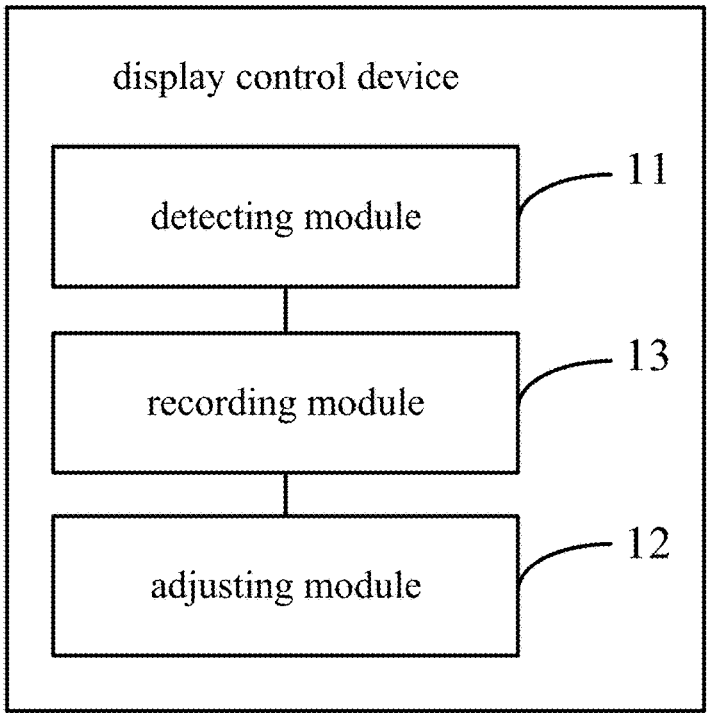
FIG. 11 is a block diagram illustrating a display control device according to another exemplary embodiment.

FIG. 11 is a block diagram illustrating a display control device according to another exemplary embodiment. As illustrated in FIG. 11, based on the embodiments illustrated in FIG. 9, the device further includes a recording module 93.

The recording module 93 is configured to record a first time duration during which the first brightness is lower than the first preset brightness threshold, and/or record a second time duration during which the second brightness is lower than the second preset brightness threshold.

The detecting module 91 is configured to determine that the display panel is in the low brightness mode when the first time duration is greater than a first preset time duration, and/or determine that the display panel is in the low ambient light mode when the second time duration is greater than a second preset time duration.

In at least one embodiment, the adjusting module is further configured to disable the eye protection mode when determining that the display panel exits the low brightness mode and/or the low ambient light mode.

In at least one embodiment, the adjusting module is further configured to determine that the display panel exits the low brightness mode when the first brightness is increased to be higher than the first preset brightness threshold; and determine that the display panel exists the low ambient light mode when the second brightness is increased to be higher than the second preset brightness threshold.

With respect to the devices in the above embodiments, the specific manners for performing operations for individual modules therein have been described in detail in the embodiments regarding the display control methods, which will not be elaborated herein.

Since the device embodiments substantially correspond to the method embodiments, reference is made to the description of the method embodiments. The above-described device embodiments are merely for the purpose of illustration. Those units described as separated components may or may not be physically separated, and those units described as one display component may or may not be physical units, i.e., either located at one place, or distributed onto a plurality of network units. The object of the present disclosure may be achieved by part or all of modules in accordance with practical requirements. It would be appreciated and executable by those skilled in the art without creative labor.

Accordingly, the present disclosure further provides a display control device, including a processor, a memory configured to store instructions executable by the processor. The processor is configured to: detect whether a display panel is in a low brightness mode and/or a low ambient light mode, in which, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; enable an eye protection mode when it is determined that the display panel is in the low brightness mode and/or the low ambient light mode, in which, in the eye protection mode, brightness of a color component of the display panel is further reduced with respect to the low brightness mode to reduce damage to human eyes.

Accordingly, the present disclosure further provides a terminal, including a memory having one or more programs stored therein. When the one or more programs are executed by one or more processors, the following instructions can be performed: detecting whether a display panel is in a low brightness mode and/or a low ambient light mode, in which, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and enabling an eye protection mode when determining that the display panel is in the low brightness mode and/or the low ambient light mode, in which, in the eye protection mode, brightness of a color component of the display panel is further reduced with respect to the low brightness mode to reduce damage to human eyes.

Figure 12:
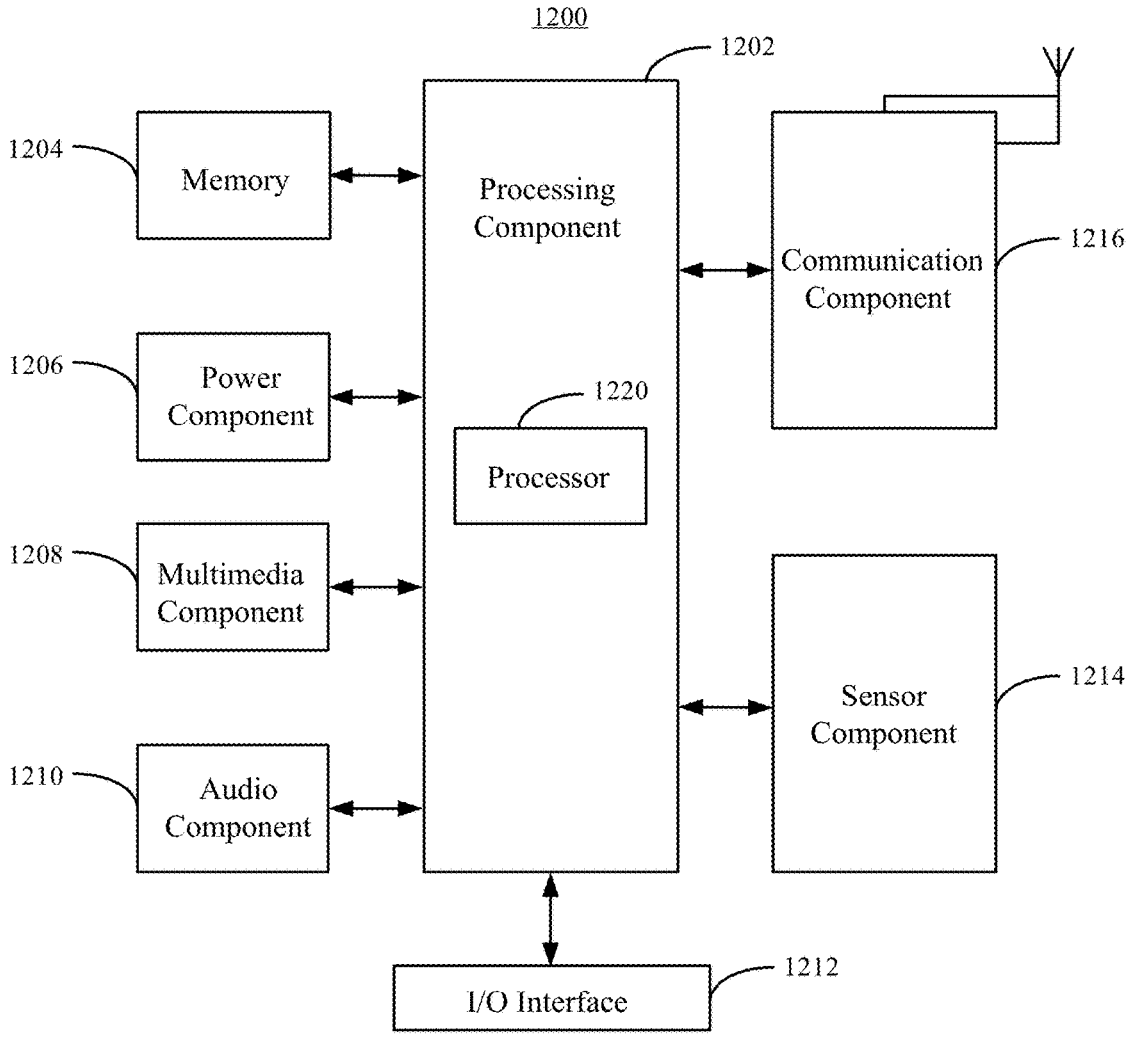
FIG. 12 is a block diagram illustrating a display control device according to an exemplary embodiment.

FIG. 12 is a block diagram illustrating a display control device 1200 according to an exemplary embodiment. Fox example, the device 1200 may be a mobile phone, a computer, a digital broadcasting terminal, a message transceiver device, a game console, a tablet device, a medical device, a fitness device and a personal digital assistant.

Referring to FIG. 12, the device 1200 may include one or more of the following components: a processing component 1202, a memory 1204, a power component 1206, a multimedia component 1208, an audio component 1210, an input/output ("I/O") interface 1212, a sensor component 1214, and a communication component 1216.

The processing component 1202 typically controls overall operations of the device 1200, such as the operations associated with display, telephone calls, data communications, camera operations, and recording operations. The processing component 1202 may include one or more processors 1220 to execute instructions to perform all or part of the steps in the above described methods. Moreover, the processing component 1202 may include one or more modules to facilitate the interaction between the processing component 1202 and other components. For instance, the processing component 1202 may include a multimedia module to facilitate the interaction between the multimedia component 1208 and the processing component 1202.

The memory 1204 is configured to store various types of data to support the operation of the device 1200. Examples of such data include instructions for any applications or methods operated on the device 1200, contact data, phonebook data, messages, pictures, videos, etc. The memory 1204 may be implemented using any type of volatile or non-volatile memory devices, or a combination thereof, such as a static random access memory ("SRAM"), an electrically erasable programmable read-only memory ("EEPROM"), an erasable programmable read-only memory ("EPROM"), a programmable read-only memory ("PROM"), a read-only memory ("ROM"), a magnetic memory, a flash memory, a magnetic or optical disk.

The power component 1206 provides power to various components of the device 1200. The power component 1206 may include a power management system, one or more power sources, and any other components associated with the generation, management, and distribution of power in the device 1200.

The multimedia component 1208 includes a screen providing an output interface between the device 1200 and the user. In some embodiments, the screen may include a liquid crystal display ("LCD") and a touch panel ("TP"). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1208 includes a front camera and/or a rear camera. When the device 1200 is in an operating mode, such as a photographing mode or a video mode, the front camera and/or the rear camera can receive external multimedia data. Each of the front camera and the rear camera may be a fixed optical lens system or has focal length and optical zoom capability.

The audio component 1210 is configured to output and/or input audio signals. For example, the audio component 1210 includes a microphone ("MIC") configured to receive an external audio signal when the device 1200 is in an operation mode, such as a call mode, a recording mode, and a voice recognition mode. The received audio signal may be further stored in the memory 1204 or transmitted via the communication component 1216. In some embodiments, the audio component 1210 further includes a speaker to output audio signals.

The I/O interface 1212 provides an interface between the processing component 1202 and peripheral interface modules, such as a keyboard, a click wheel, buttons, and the like. The buttons may include, but are not limited to, a home button, a volume button, a starting button, and a locking button.

The sensor component 1214 includes one or more sensors to provide status assessments of various aspects of the device 1200. For instance, the sensor component 1214 may detect an on/off status of the device 1200, relative positioning of components, e.g., a display and a keypad of the device 1200, a change in position of the device 1200 or a component of the device 1200, a presence or absence of user contact with the device 1200, an orientation or an acceleration/deceleration of the device 1200, and a change in temperature of the device 1200. The sensor component 1214 may include a proximity sensor configured to detect the presence of nearby objects without any physical contact. The sensor component 1214 may also include a light sensor, such as a complementary metal-oxide semiconductor ("CMOS") or a charge coupled device ("CCD") image sensor, for use in imaging applications. In some embodiments, the sensor component 1214 may also include an accelerometer sensor, a gyroscope sensor, a magnetic sensor, a pressure sensor, or a temperature sensor.

The communication component 1216 is configured to facilitate wired or wireless communication between the device 1200 and other devices. The device 1200 can access a wireless network based on a communication standard, such as WiFi, 2G, or 3G, or a combination thereof. In one exemplary embodiment, the communication component 1216 receives a broadcast signal or broadcast-associated information from an external broadcast management system via a broadcast channel. In one exemplary embodiment, the communication component 1216 further includes a near field communication ("NFC") module to facilitate short-range communications. For example, the NFC module may be implemented based on a radio frequency identification ("RFID") technology, an infrared data association ("IrDA") technology, an ultra-wideband ("UWB") technology, a Bluetooth ("BT") technology, and other technologies.

In exemplary embodiments, the device 1200 may be implemented with one or more application specific integrated circuits ("ASICs"), digital signal processors ("DSPs"), digital signal processing devices ("DSPDs"), programmable logic devices ("PLDs"), field programmable gate arrays ("FPGAs"), controllers, micro-controllers, microprocessors, or other electronic components, for performing the methods described above.

In exemplary embodiments, there is also provided a non-transitory computer-readable storage medium including instructions, such as included in the memory 1204, executable by the processor 1220 in the device 1200, for performing the above-described methods. For example, the non-transitory computer-readable storage medium may be a read-only memory ("ROM"), a random access memory ("RAM"), a CD-ROM, a magnetic tape, a floppy disk, an optical data storage device, and the like.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A display control method, comprising:

detecting whether a display panel is in at least one of a low brightness mode and a low ambient light mode, wherein, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and enabling an eye protection mode when it is determined that the display panel is in at least one of the low brightness mode and the low ambient light mode, wherein, in the eye protection mode, brightness of a color component of the display panel is reduced with respect to in the low brightness mode to reduce damage to human eyes;

wherein enabling an eye protection mode comprises:

reducing brightness of blue sub-pixels in pixel units of the display panel, and adjusting brightness of other sub-pixels in the pixel units according to a blackbody trajectory and the reduced brightness of the blue sub-pixels.

2. The method according to claim 1, wherein enabling an eye protection mode comprises:

reducing brightness of the blue sub-pixels in the pixel units of the display panel, and according to a blackbody trajectory and the reduced brightness of the blue sub-pixels, adjusting the brightness of the other sub-pixels in the pixel units to reduce the brightness of the pixel units by 10% to 20%.

3. The method according to claim 2, further comprising:

disabling the eye protection mode when it is determined that the display panel exits at least one of the low brightness mode and the low ambient light mode.

4. The method according to claim 1, wherein adjusting the brightness of the other sub-pixels in the pixel units comprises at least one of the following acts:

reducing brightness of green sub-pixels in the pixel units; and increasing brightness of red sub-pixels in the pixel units.

5. The method according to claim 4, further comprising:
disabling the eye protection mode when it is determined that the display panel exits at least one of the low brightness mode and the low ambient light mode.

6. The method according to claim 1, wherein detecting whether a display panel is in at least one of a low brightness mode and a low ambient light mode comprises:
when the first brightness is lower than the first preset brightness threshold and/or the second brightness is lower than the second preset brightness threshold, recording a first time duration during which the first brightness is lower than the first preset brightness threshold, and/or recording a second time duration during which the second brightness is lower than the second preset brightness threshold; and
determining that the display panel is in the low brightness mode when the first time duration is greater than a first preset time duration, and/or determining that the display panel is in the low ambient light mode when the second time duration is greater than a second preset time duration.

7. The method according to claim 6, further comprising:
disabling the eye protection mode when it is determined that the display panel exits at least one of the low brightness mode and the low ambient light mode.

8. The method according to claim 1, further comprising:
disabling the eye protection mode when it is determined that the display panel exits at least one of the low brightness mode and the low ambient light mode.

9. The method according to claim 8, wherein determining that the display panel exits the low brightness mode comprises:
determining that the display panel exits the low brightness mode when the first brightness is increased to be higher than the first preset brightness threshold; and
determining that the display panel exists the low ambient light mode when the second brightness is increased to be higher than the second preset brightness threshold.

10. The method according to claim 1, further comprising:
disabling the eye protection mode when it is determined that the display panel exits at least one of the low brightness mode and the low ambient light mode.

11. A display control device, comprising:
a processor; and
a memory, configured to store instructions executable by the processor;
wherein, the processor is configured to:
detect whether a display panel is in at least one of a low brightness mode and a low ambient light mode, wherein, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and
enable an eye protection mode when it is determined that the display panel is in at least one of the low brightness mode and the low ambient light mode, wherein, in the eye protection mode, brightness of a color component of the display panel is reduced with respect to in the low brightness mode to reduce damage to human eyes;
wherein the processor is configured to enable an eye protection mode by:
reducing brightness of blue sub-pixels in pixel units of the display panel, and adjust brightness of other sub-pixels in the pixel units according to a blackbody trajectory and the reduced brightness of the blue sub-pixels.

12. The device according to claim 11, wherein, the processor is configured to enable an eye protection mode by:
reducing brightness of the blue sub-pixels in the pixel units of the display panel, and according to a blackbody trajectory and the reduced brightness of the blue sub-pixels, adjusting the brightness of the other sub-pixels in the pixel units to reduce the brightness of the pixel units by 10% to 20%.

13. The device according to claim 11, wherein, the processor is configured to adjust the brightness of the other sub-pixels in the pixel units by at least one of the following acts:
reducing brightness of green sub-pixels in the pixel units; and
increasing brightness of red sub-pixels in the pixel units.

14. The device according to claim 11, wherein, the processor is configured to detect whether a display panel is in at least one of a low brightness mode and a low ambient light mode by:
when the first brightness is lower than the first preset brightness threshold, and/or the second brightness is lower than the second preset brightness threshold, recording a first time duration during which the first brightness is lower than the first preset brightness threshold, and/or recording a second time duration during which the second brightness is lower than the second preset brightness threshold; and
determining that the display panel is in the low brightness mode when the first time duration is greater than a first preset time duration, and/or determining that the display panel is in the low ambient light mode when the second time duration is greater than a second preset time duration.

15. The device according to claim 11, wherein, the processor is further configured to
disable the eye protection mode when it is determined that the display panel exits at least one of the low brightness mode and the low ambient light mode.

16. The device according to claim 15, wherein, the processor is configured to determine that the display panel exits the low brightness mode by:
determining that the display panel exits the low brightness mode when the first brightness is increased to be higher than the first preset brightness threshold; and
determining that the display panel exists the low ambient light mode when the second brightness is increased to be higher than the second preset brightness threshold.

17. A non-transitory computer readable storage medium, configured to store computer programs that, when executed by a processor, implement following acts:
detecting whether a display panel is in at least one of a low brightness mode and a low ambient light mode, wherein, first brightness of the display panel when the display panel is in the low brightness mode is lower than a first preset brightness threshold, and second brightness of ambient light in an environment where the display panel is located when the display panel is in the low ambient light mode is lower than a second preset brightness threshold; and
enabling an eye protection mode when it is determined that the display panel is in at least one of the low brightness mode and the low ambient light mode, wherein in the eye protection mode, brightness of a color component of the display panel is reduced with respect to in the low brightness mode to reduce damage to human eyes;

wherein enabling an eye protection mode comprises:

reducing brightness of blue sub-pixels in pixel units of the display panel, and adjusting brightness of other sub-pixels in the pixel units according to a blackbody trajectory and the reduced brightness of the blue sub-pixels.

* * * * *